United States Patent [19]

King

[11] Patent Number: 4,736,875

[45] Date of Patent: Apr. 12, 1988

[54] TIMING MECHANISM

[76] Inventor: Alan M. King, 1750 Blvd. Toschereau, Ville Lemoyne, P.Q., Canada, J4P 3M9

[21] Appl. No.: 919,617

[22] Filed: Oct. 14, 1986

Related U.S. Application Data

[63] Continuation of Ser. No. 526,377, Aug. 25, 1983, abandoned, which is a continuation-in-part of Ser. No. 412,232, Aug. 27, 1982, abandoned.

[51] Int. Cl.[4] ..... G04C 25/50

[52] U.S. Cl. ..... 222/641; 222/505

[58] Field of Search ..... 222/43, 48, 505, 517, 222/557, 639, 640, 641, 642, 643, 646, 517

[56] References Cited

U.S. PATENT DOCUMENTS

| | | | |
|---|---|---|---|
| 2,682,984 | 7/1954 | Melikian et al. | 194/13 X |
| 2,770,398 | 11/1956 | Sauerman | 222/517 X |
| 2,975,937 | 3/1961 | Totten | 222/640 |
| 3,160,318 | 12/1964 | Steiner et al. | 222/43 |
| 3,169,675 | 2/1965 | Gutzmann et al. | 222/517 X |
| 3,305,139 | 2/1967 | Ward | 222/557 X |
| 3,713,522 | 1/1973 | Estrem | 194/9 T |
| 3,976,222 | 8/1976 | Spagnolo | 222/641 |

*Primary Examiner*—F. J. Bartuska

[57] ABSTRACT

An apparatus for a customer-operated dispensing machine includes an infinitely variable selector which enables the customer to select a continuously variable quantity of a product dispensed by a dispensing mechanism thereof, the apparatus being adapted to actuate the product dispensing mechanism to thereby dispense the product. The apparatus includes a manually pivotable switch for adjusting the dispensing time of the dispensing mechanism and/or a manually pivotable stopper for adjusting the dispensing rate of the dispensing mechanism to thereby adjust the quantity of the product dispensed.

2 Claims, 5 Drawing Sheets

101

115
103
113
105
110
109
107
106
118
111
117
112
119

101

107
103
123
126
104
117
105
118
121
124
125
119

TIMING MECHANISM

CROSS-REFERENCE TO RELATED APPLICATION

This is a continuation of application Ser. No. 526,377 filed Aug. 25, 1983, now abandoned, which is a continuation-in-part application of parent application Ser. No. 412,232, filed Aug. 27, 1982, which is abandoned.

BACKGROUND OF INVENTION (a) Field of the Invention

The invention relates to an apparatus for a customer-operated dispensing machine wherein the customer can select a continuously variable quantity of a product dispensed by a dispensing mechanism. More specifically, the invention relates to such apparatus with means for adjusting either the dispensing time or the dispensing rate of the dispensing mechanism to thereby adjust the quantity of the product dispensed.

(b) Description of Prior Art

With presently available dispensing machines, quantities of a secondary product can be customer-selected, for dispensing by the dispensing mechanism thereof, only in discrete amounts. Thus, with a coffee dispensing machine, one can select only a preset discrete amount of sugar (for example 0, 1 or 2 spoons), and a discrete amount of cream (usually 0, regular and light). Customers preferring amounts of sugar or cream of different quantities than permitted by the dispensing machine can therefore never be fully satisfied by the combined product delivered. For example, if a customer desires only half a spoon of sugar, or one and a half spoons of sugar, it is not possible to have his taste fully satisfied with present day dispensing U.S. Pat. No. 3,794,149, teaches an adjustable timing cam for hot drink dispensers. However, the adjustment of the timing cam is a factory adjustment and not under the control of the customer.

To applicant's knowledge, there are no means for adjusting the dispensing rate of a dispensing mechanism.

SUMMARY OF INVENTION

It is therefore an object of the invention to provide a timer mechanism which overcomes the disadvantages of the prior art.

It is a more specific object of the invention to provide a timer mechanism for a customer-operated dispensing machine by which the customer can select a continuously variable quantity of a secondary product dispensed by a dispensing mechanism.

It is an even more specific object of the invention to provide such a timer mechanism which includes means for adjusting either the dispensing time or the dispensing rate of a dispensing mechanism to thereby adjust the quantity of the product dispensed.

It is also an object of the invention to provide a method for a customer-operated dispensing machine whereby the customer can select a continuously variable quantity of a secondary product dispensed by a dispensing mechanism.

In accordance with the invention, there is provided a timer mechanism for a customer-operated dispensing machine by which the customer can select a continuously variable quantity of a secondary product dispensed by a dispensing mechanism thereof, the apparatus being adapted to actuate the secondary product dispensing mechanism to thereby dispense the product.

The device includes means for continuously adjusting the dispensing time or the dispensing rate of the dispensing mechanism, to thereby dispense a continuously variable quantity of the product from the dispensing mechanism.

The invention also relates to a method for a customer-operated dispensing machine by which the customer can select a continuously variable quantity of a product dispensed by a dispensing mechanism thereof and to an apparatus adapted to actuate the product dispensing mechanism to thereby dispense the product, the apparatus including means for continuously varying the dispensing time or the dispensing rate of the dispensing mechanism. The method includes the step of adjusting either the dispensing time or the dispensing rate of the dispensing mechanism. The dispensing mechanism is actuated to dispense a variable quantity of the product.

BRIEF DESCRIPTION OF DRAWINGS

The invention is now described with reference to the accompanying drawings which show preferred forms thereof and wherein.

DESCRIPTION OF PREFERRED EMBODIMENTS

Figure 4:
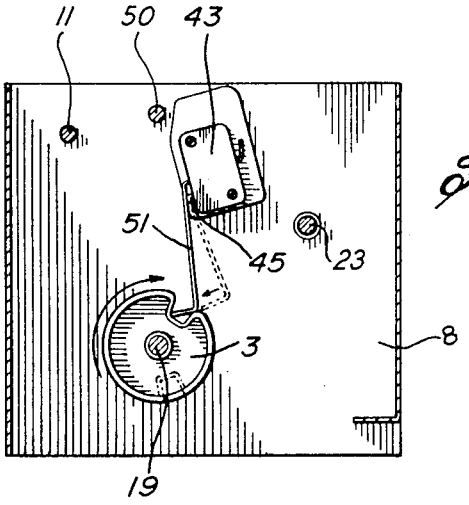
FIG. 4 illustrates a cycle cam.

As shown on the drawings, the timer mechanism, illustrated generally at 1, includes a cycle cam 3 and one or more product timer cams 5. As shown in FIG. 4, the cycle cam 3 is a notch cam whereas the product timer cams 5 include raised portions 5*a* (FIG. 5) and unraised portions.

Figure 1:
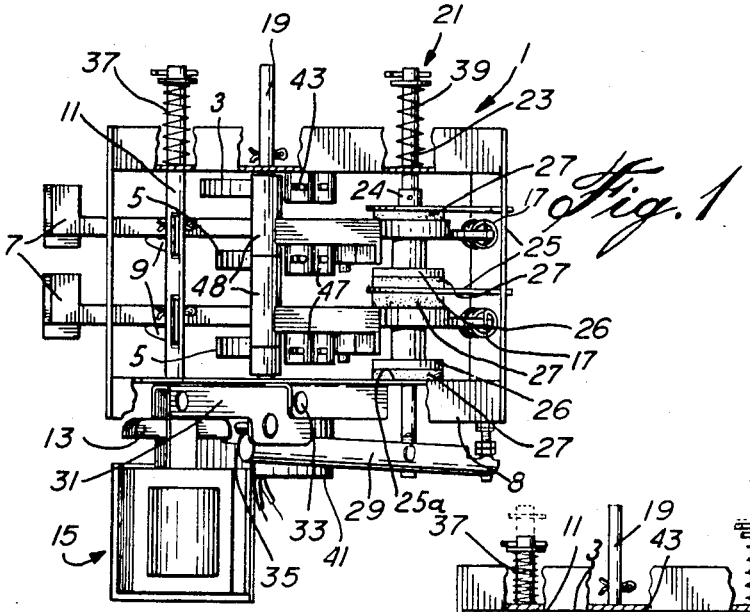
FIG. 1 is a top view of the timer mechanism with a solenoid in its unactuated position.
Figure 2:
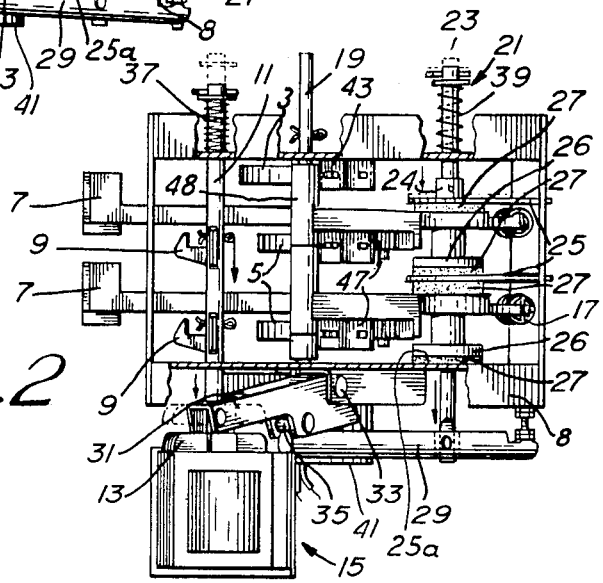
FIG. 2 is a top view of the timer mechanism with the solenoid in its actuated position, small arrows indicating the direction in which parts have moved.
Figure 5:
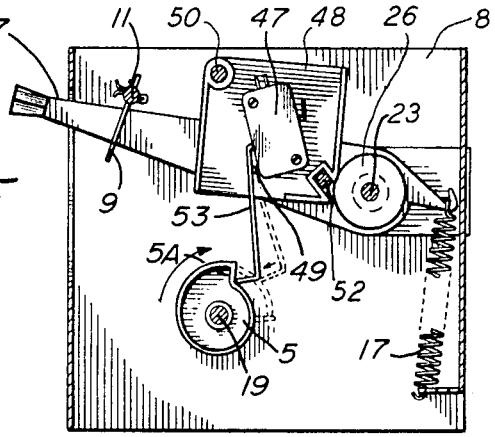
FIG. 5 illustrates a product timer cam with the lever arm in its lowest position.
Figure 6:
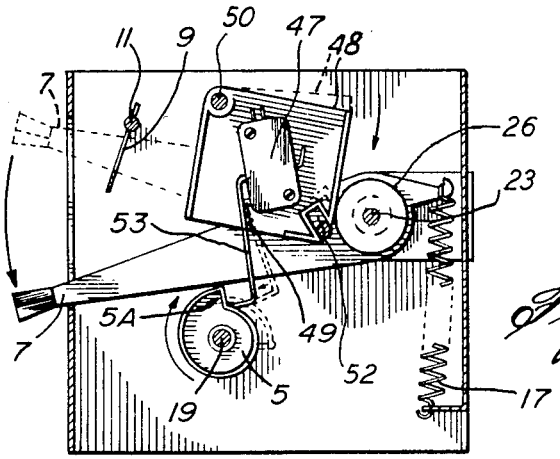
FIG. 6 illustrates the product timer cam with the lever arm in its highest position.

As shown in FIGS. 1 and 2, associated with each product timer cam 5 is a selector lever arm 7. Movement of each lever arm 7, when the timer is in its unactuated position, is prevented by a latch 9 which is mounted on a movable latch rod 11. An end of the latch rod 11 is connected to a plunger 13 of a solenoid 15 for axial movement. As shown in FIGS. 5 and 6, each of the selector lever arms 7 is pivotable about a rod 23 and it is urged into its upper or non-select position (i.e., the position at which none of the secondary product is selected) by a spring 17.

Figure 3:
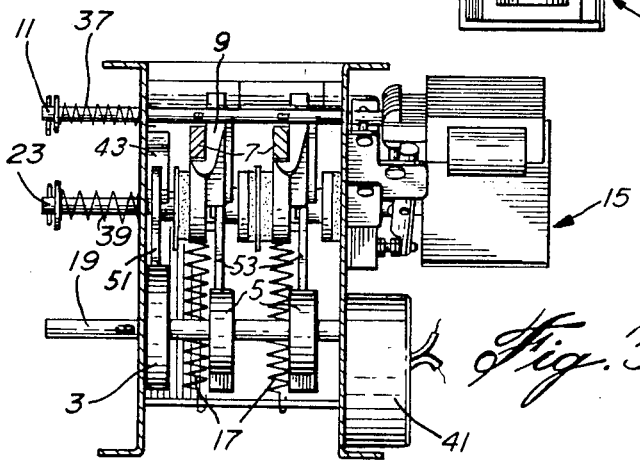
FIG. 3 is a vertical sectional view, taken from the front of the timer mechanism, with parts omitted.

As best shown in FIGS. 1, 2 and 3, all of the cams 3, 5, are co-rotatably mounted for rotation on a common cam axle 19.

A brake mechanism 21 is provided for holding each of the selector lever arms 7 in a selected position. The brake mechanism includes an axially movable support rod 23 slidably mounted on a frame 8, a pair of non-rotatable apertured friction plates 25 secured to the frame 8 and through which the support rod extends, a reaction surface 25*a* on the frame 8, a pair of hubs 26 secured to the selector lever arms 7 and pivotally supported on the support rod 23, and four friction or rubber rings 27 respectively disposed at opposite ends of said hubs 26 for frictionally acting between an end thereof and one of said friction plates 25 or reaction surface 25*a*. A collar 24 is pinned to the support rod 23 at such point as to provide such axial preload through the friction plates 25, 25, the four friction rings 27, and the hubs 26, 26 against the reaction surface 25*a* as may be desired in the unactuated position, and so as to transmit the axial braking force from the support rod 23 to the components disposed between the reaction surface 25*a* and the more remote friction plate 25.

A pull rod 29 is pivotally connected near one end thereof to an end of the support rod 23. The closer end thereof is adjustably fulcrumed on the frame 8, while the more remote end is reciprocated. The pull rod 29 is reciprocated by a pivoting member 31, which pivoting member has one end pivotably connected to the frame 8 at 33 and the other end connected to the plunger 13 of an electric solenoid 15. The pivoting member 31 has a roller 35 which engages the free end of the pull rod 29 to force it downwardly as is explained below. The pivoting member 31 is a second class lever acting through the roller 35 on the pull rod 29, which in turn is also a second class lever for acting on the brake support rod 23.

A latch rod spring 37 urges the latch rod 11, and hence the solenoid plunger 13, into its locked or uppermost position (as drawn) as shown in FIG. 1 while a brake rod spring 39 urges the brake support rod 23 into its uppermost position (as drawn). A motor 41 is connected to the cam axle 19 through an internal gear train, not shown, to thereby rotate the cams 3 and 5.

As shown in FIGS. 4, 5 and 6, a cycle cam switch 43 having an actuating pin 45, is fixedly secured to the frame 8 and is associated with the cycle cam 3, while a product cam switch 47, having an actuating pin 49, is associated with each product timer cam 5. The cycle cam switch 43 has a cam-follwer or switch arm 51, and each product cam switch 47 has a cam follower or switch arm 53. Each switch 43, 47 can be actuated by movement of the switch arms 51, 53 towards the respective actuating pin 45, 49 so that the switch arm shifts the actuating pin 45, 49. Each product cam switch 47 is fixedly secured to a mounting plate 48 pivotally supported on a pin 50 carried on the frame 8, there being a pin-and-slot connection 52 between each selector lever arm 7 and one of the pivotal mounting plates 48. When the selector arm 7 is in its uppermost position, the pin-and-slot connection moves the mounting plate 48 to its uppermost position, and hence pivots the switch 47 as far away from the cam 5 as possible. But when the selector arm 7 is lowered to its lowermost position, the pin-and-slot connection pivots the switch 47 as close to the cam 5 as possible. The position of the switch cam thus is shifted over a range with respect to the cam 5 where it is not actuated to where it is continuously actuated for the duration of the cam cycle.

Figure 7:
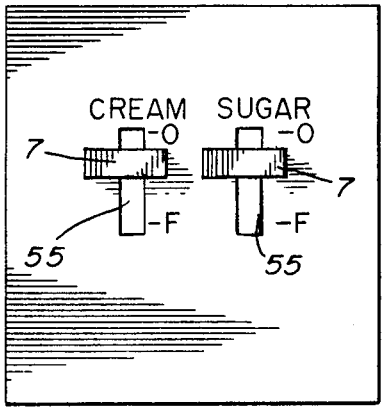
FIG. 7 illustrates an example of a customer product selection panel for selecting continuously variable amounts of a product.

FIG. 7 shows a customer panel for the continuously variable selection of a product such as, for example, cream and sugar in a coffee dispensing machine. The selector lever arms 7 are each movable in a slot 55. The panel is marked or calibrated at the top and at the bottom of each slot to indicate appropriate quantities. In FIG. 7, these markings are illustrated as zero (0) and full (F). Other appropriate markings or calibrations could be selected.

In operation, the timer works as follows:

When a coin is placed into a coin mechanism of a dispensing machine, the coin mechanism will actuate the electric solenoid 15 so that the latch rod 11 is moved laterally (appearing downwardly in FIG. 2) to release the selector lever arms 7. Simultaneously the electric solenoid 15 actuates the brake mechanism 21 to maximize the braking force on the lever arms. The customer can now adjust the lever arms to the amount of supplementary product desired in his selected drink. On doing so, the brake mechanism 21 is manually over-ridden and more energy is stored in the springs 17. The brake mechanism 21 will hold each lever arm 7 in the selected position. As shown in FIG. 2, the friction or rubber rings 27 are compressed against the hubs 26 of the selector lever arms 7 and the friction surfaces of the friction plates 25 and the reaction surface 25*a* due to the pulling action of the support rod acting through the collar 24. The compressed rubber acting against the sides of the lever arm hubs 26 will brake the selector levers at any selected position.

The pivot member 31 amplifies the force from the solenoid. Thus, the solenoid is loaded only to the extent of retaining the movable end of the pivot member 31 in its actuated position rather than having to hold down the support rod 23 against the full force of the spring 39. The roller 35 of the pivoting member 31 urges the free end of the rod 29 to the actuated position of FIG. 2 to thereby actuate the brake support rod 23.

After the selector levers 7 have been set in their selected position, a further customer-actuated signal initiates the dispensing of the main product, which also energizes the motor 41 independently of the switch 43. The motor 41 rotates the axle 19 to thereby rotate the cams 3 and 5. The cam 3 actuates the switch 43 which is in a holding circuit for the motor 41. The cam 3 thus ensures that the motor 41 will remain energized so that cam rotation ceases after a travel of 360°. Thus, when a travel of 360° is completed, the arm 51 falls into the notch of the cam 3 so that the switch 43 is deactuated to turn off the motor 41.

The switch 47 is provided for being connected to a secondary product dispensing means such as a product door opener or to a product motor dispenser to actuate the dispensing means by either opening the door or turning on the motor dispenser. When the arm 53 moves into a position to actuate the switch 47, by displacing the actuating pin 49, such secondary product dispensing means is activated. It is the duration of such activation which this invention provides.

As shown in FIG. 5, with the lever 7 in its topmost position, the switch arm 53 cannot depress the actuating pin 49 even if the free end of the arm 53 were riding on the raised portion 5*a* of the cam 5. Thus no supplementary product can be dispensed. When the lever arm 7 is in the lowermost position, as shown in FIG. 6, the switch arm 53 will depress the actuating pin 49 continuously for any cam position, i.e. the full cycle of the cam 5. Thus, the actuating pin 49 will be depressed for a longer time, to provide a longer time period, when the lever arm is in the postion shown in solid lines in FIG. 6 than when the lever arm is in the position shown in solid lines in FIG. 5. Accordingly, a greater quantity would be dispensed with the lever arm in the bottom-most position as shown in FIG. 6.

When the lever arm 7 is moved to a position intermediate the topmost and bottom-most positions, the amount of time that the actuating pin will remain depressed is intermediate between the time of FIG. 5 and the time of FIG. 6, that is, the time period and therefore the amount of product dispensed, will be intermediate the time period, and therefore the amount dispensed in the FIG. 5 position and the time period and therefore the amount dispensed in the FIG. 6 position. As the position of the lever arm is continuously variable, the amount of product dispensed is also continuously variable. Product is dispensed in the time period during which the actuating pin is depressed.

Figure 8:
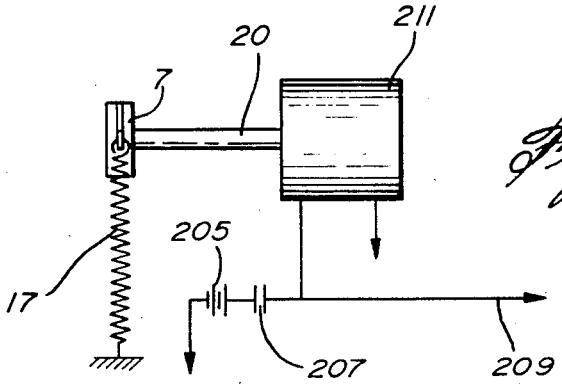
FIG. 8 is a highly schematic illustration of a variable RC timing circuit.

Although a particular mechanical timing arrangement has been illustrated for showing how a continuously variable quantity of a product can be selected, this construction represents only one approach. A different approach is to use electronic timer means, for example, as shown in FIG. 8, a rheostat 211 is connected in series with a capacitor 207. A shaft 20 of the variable rheostat 211 will rotate when the lever 7 is pivoted about the support rod 23 as illustrated above.

A source of power, illustrated in the drawings as a battery 205, is connected in series with the capacitor 207. One output of the rheostat 211 is connected to the other side of the capacitor 207. The other output of the rheostat is grounded.

A lead 209 is connected to the dispensing motor or a product door opener to provide a power input for a period of time as determined by the RC constant.

Figure 9:
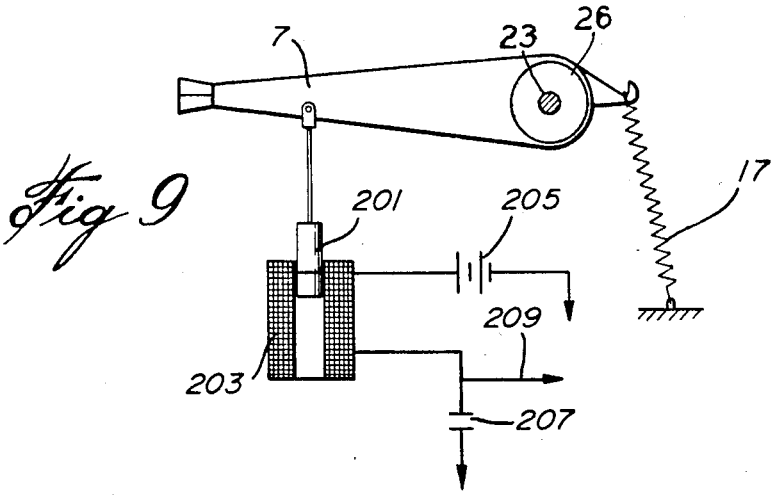
FIG. 9 is a highy schematic illustration of a variable LC timing circuit.

In a further electronic embodiment, an LC timing circuit is used as shown in FIG. 9, a slotted movable ferromagnetic core 201 of an inductor 203 is connected to be upwardly and downwardly movable with the pivoting of the lever 7. One output of the inductor 203 is connected to a source of power, illustrated as the battery 205. The other output of the inductor 203 is connected to the top end of the capacitor 207. The lead 209 is connected to a product dispensing motor or a product door opener which will be activated for a period dependent on the LC constant which is, in turn, dependent on the position of the lever 7.

Figure 10:
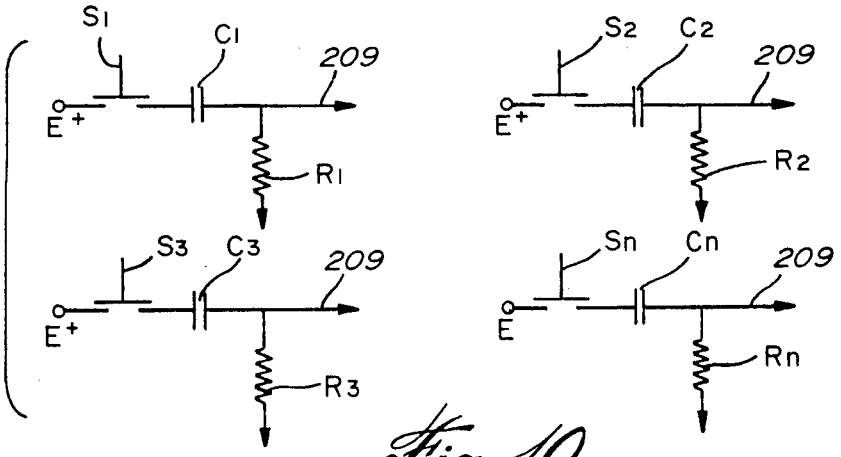
FIG. 10 is a highly schematic illustration of a Mylar (TM) switch variable RC timing circuit.

In a different arrangement shown in FIG. 10, a series of RC circuit having different time constants is connected through a set of Mylar TM switches collectively forming a selector switch assembly, to a source of power E. A customer would select the amount of product desired by pressing the appropriate Mylar TM switch which would then activate its associated timing circuit. The timing arrangement would activate either a product door opener or a product dispensing motor. In FIG. 10, S1, S2, S3 . . . Sn are Mylar switches which would appear on the face of the machine. RC circuits, R1C1, R2C2, R3C3 . . . RnCn are arranged so that each one has a different value. Thus, by pressing a different one of the switches, a different time constant is selected.

Figure 11:
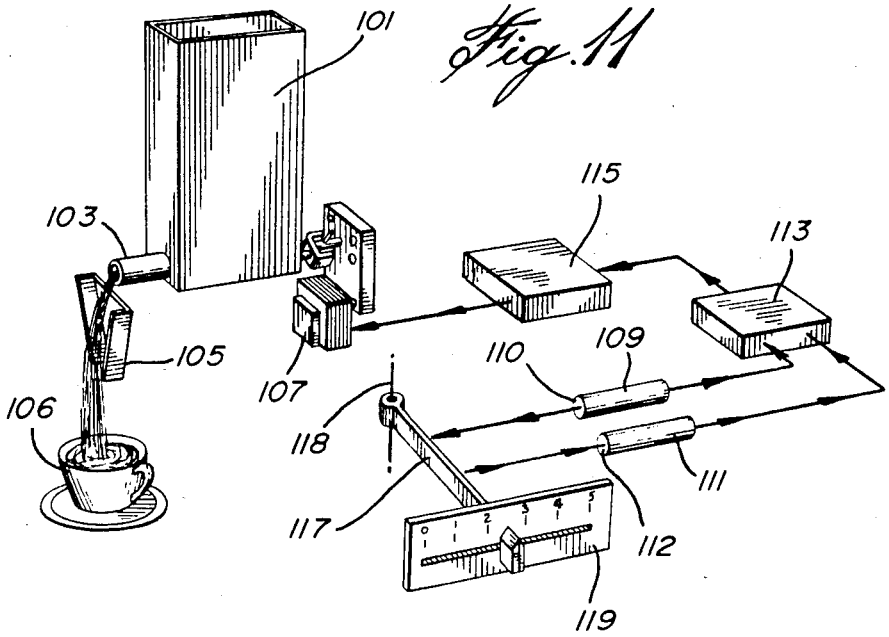
FIG. 11 illustrates an embodiment of a timer arrangement using a wave signal transmitter and receiver arrangement.

FIG. 11 illustrates yet another embodiment for providing a continuously variable quantity of a product from a dispenser. In FIG. 11 a hopper 101 for storing the product has an output means such as a funnel or spout 103 through which the product from the hopper is dispensed. A guide means 105 may guide the product to a container such as a cup 106 or the like. The product is dispensed from the hopper 101 by means of a dispensing motor 107.

A transmitter 109 is adapted to transmit electromagnetic wave signals. A receiver 111 receives the waves after a variable interval as is explained below, and a calculator 113 receives a reference signal from the transmitter 109 and the delayed signal from the receiver 111, and calculates the distance the waves have travelled between the transmitter output 110 and the receiver input 112. Such means are well known in the art and require no further description here.

The calculated distance is then provided, as an analog or digital signal, to a converter 115 which converts the distance to a time. The output of 115 is fed to the dispensing motor 107 to turn the motor on for the time as provided at the output of the calculator 115.

In order to vary the time period in the embodiment illustrated in FIG. 11, the length of the travel path between the output 110 of the transmitter 109 and the input 112 of the receiver 111 is varied. In the illustrated embodiment, the length of the path is varied by a movable means, for example, a movable adjustment arm 117. The adjustment arm is positioned along a scale 119 to provide an indication to the customer of the quantity of the product he has selected.

In operation, the output 110 of the transmitter 109 is directed at the movable arm 117. The input 112 of the receiver 111 is also directed at the movable arm 117. Accordingly, signal waves transmitted by the transmitter 109 will propagate to the arm 117 and be bounced off the arm back to the input 112 of the receiver. Moving the movable arm, by pivoting it about a pivot point 118, will change both the distance from the output 110 of the transmitter 109 to the movable arm 117 as well as the distance from the movable arm 117 to the input 112 of the receiver 111. Accordingly, by pivoting the movable arm, the travel path between the output 110 of the transmitter 109 and the input 112 of the receiver 111 is varied.

The path length is calculated in the calculator 113 in, for example, the same manner that path length is calculated in a radar system. The path length quantity is then transmitted, either as an analog level, or a digitally coded signal, to converter 115 where the quantity is converted to a time period. The converter 115 will then turn the dispensing motor on for a period equal to the time period as arrived at in the converter 115, so that the dispensing motor will cause the product to be dispensed from the hopper 101 for this time period.

Accordingly, by adjusting the position of the movable arm 117, the quantity of the product dispensed is similarly adjusted.

In all of the above arrangements, in order to provide a different quantity of product, the amount of dispensing time is adjusted. In the FIG. 12 embodiment, the dispensing time is constant for all quantities dispensed. However, the total quantity dispensed is varied by varying the dispensing rate.

Figure 12:
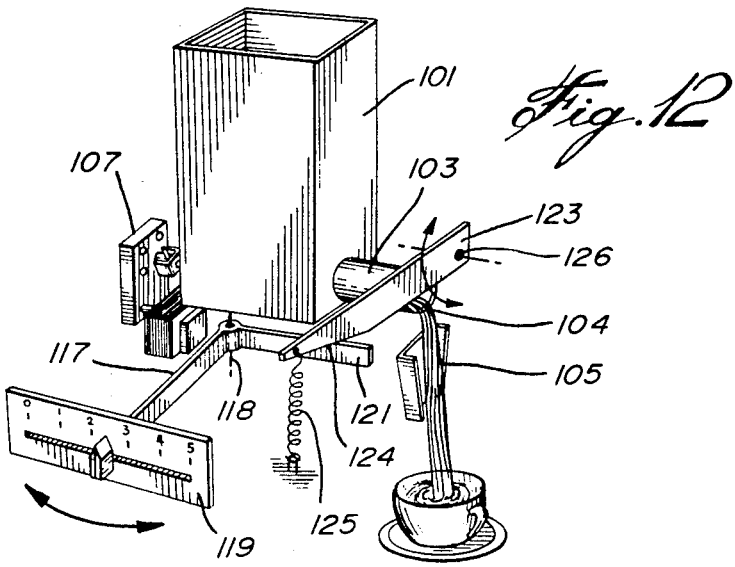
FIG. 12 illustrates a further approach for providing a continuously variable quantity of a product from a dispensing machine.

In FIG. 12, the movable arm 117 includes a lifter portion 121. The lifter portion adjusts the level of a movable stopper means 123, which is disposed in front of the opening 104 of the output funnel or spout 103 of the hopper 101, by sliding along a ramp portion 124 of the stopper 123. The front end of the stopper is biased downwardly by spring 125, and the stopper is pivotable about a point 126 at the other end thereof.

In operation, when arm 117 is pivoted about the point 118, it will cause the top edge of the lifter portion 121 to slide along the ramp 124 so that the stopper 123 will be pivoted about the point 126. In this way, a greater or lesser portion of the opening 104 will be covered. Thus, even though the dispensing motor will operate for the same period of time in all cases, a greater or lesser quantity will be dispensed depending upon the position of the arm 117.

In both the FIGS. 11 and 12 embodiments, the dispensing motor or a product door opener will be activated by insertion of a coin as described in the embodiments illustrated in FIGS. 1 to 7.

Several embodiments have been above-described for the purpose of illustrating, but not limiting, the invention. Various modifications will come readily to the mind of one skilled in the art are within the scope of the invention as defined in th appended claims.

I claim:

1. Apparatus for a customer-operated coffee dispensing machine having a coffee dispenser, by which apparatus the customer can select a continuously variable quantity of a supplemental product dispensed by a supplemental dispensing mechanism thereof, said apparatus being adapted to actuate said supplemental product dispensing mechanism to thereby dispense said supplemental product, comprising:

(a) a continuously variable timer means adapted to be connected to be energized with the coffee dispenser and initially positioned to dispense no supplemental product;

(b) means for selecting the time period of actuation of said timer means each dispensing cycle for an infinitely variable time period, (c) said variable timer means and said selecting means comprising an electrical circuit including:

(1) a rheostat having a customer infinitely movable terminal initially spring biased to a 0-time setting; and (2) a capacitor;

(3) said rheostat being reconnected in circuit with said capacitor to thereby provide a infinitely variable time period; and (d) means for connecting said timer means to said supplemental dispensing mechanism to actuate said supplemental dispensing mechanism during any said infinitely selected time period;

(e) a brake mechanism attached to said customer infinitely movable terminal to allow it to be set to a selected position during dispensing and to return to zero after each dispensing cycle;

(f) whereby said supplemental dispensing mechanism is automatically actuatable for an infinitely variable customer-selected time period to thereby dispense an infinitely variable quantity of the supplemental product and returns to zero after each dispensing cycle.

2. Apparatus according to claim 1 wherein said continuously variable timer means operates an analog signals.

* * * * *